US011421395B1

(12) United States Patent
Schurman et al.

(10) Patent No.: US 11,421,395 B1
(45) Date of Patent: Aug. 23, 2022

(54) PIN ACTUATION SYSTEM AND METHOD

(71) Applicant: DEERE & COMPANY, Moline, IL (US)

(72) Inventors: Brett D. Schurman, Dubuque, IA (US); Grant R. Henn, Dubuque, IA (US); Scott R. Stahle, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/171,522

(22) Filed: Feb. 9, 2021

(51) Int. Cl.

| | |
|---|---|
| ***E02F 3/36*** | (2006.01) |
| ***F15B 11/16*** | (2006.01) |
| ***E02F 9/22*** | (2006.01) |
| ***E02F 3/42*** | (2006.01) |

(52) U.S. Cl.
CPC ..... *E02F 3/3663* (2013.01); *E02F 3/422* (2013.01); *E02F 9/2217* (2013.01); *E02F 9/2228* (2013.01); *F15B 11/16* (2013.01); *F15B 2211/20553* (2013.01)

(58) Field of Classification Search
CPC ..... F15B 1/024; F15B 1/0275; F15B 1/033; F15B 11/16; F15B 2201/51; F15B 2211/20553; E02F 3/3609; E02F 3/3622; E02F 3/3636; E02F 3/3663; E02F 3/42
See application file for complete search history.

(56) References Cited

U.S. PATENT DOCUMENTS 5,733,095 A 3/1998 Palmer et al.
6,962,050 B2 11/2005 Hiraki et al.
6,964,122 B2 * 11/2005 Cunningham ..... E02F 3/3663 37/468
7,290,977 B2 * 11/2007 Albright ..... E02F 9/2271 403/321
7,367,256 B2 * 5/2008 Fatemi ..... E02F 9/226 91/1
8,281,506 B2 * 10/2012 Stefek ..... E02F 3/3618 37/468
8,413,572 B1 * 4/2013 Langenfeld ..... F15B 11/20 91/526

(Continued)

OTHER PUBLICATIONS

Kenkel et al., Hydraulic Fluid Warm-Up Using Ride Control Circuit, Unpublished U.S. Appl. No. 16/947,843, filed Aug. 19, 2020, 28 pages (specification and drawings).

*Primary Examiner* — Michael Leslie
(74) *Attorney, Agent, or Firm* — Michael Best & Friedrich LLP

(57) ABSTRACT

A system for operating a work vehicle includes a hydraulic control assembly and a controller. The hydraulic control assembly includes a pump, accumulator, boom hydraulic cylinder, pin hydraulic cylinder, pin control valve, and ride control valve assembly. The boom hydraulic cylinder moves a boom of the work vehicle. The pin hydraulic cylinder moves a pin on the boom. The ride control valve assembly includes a charge valve and discharge valve. The charge valve is in fluid communication with the pump and the accumulator. The discharge valve is in fluid communication with the accumulator and a reservoir. The controller operates the work vehicle in a ride control mode and pin actuation mode. The pin actuation mode includes opening the charge valve with the discharge valve closed, and directing hydraulic fluid through the pin control valve.

20 Claims, 7 Drawing Sheets

(56) References Cited

U.S. PATENT DOCUMENTS

| | | | | |
|---|---|---|---|---|
| 8,863,640 | B2 * | 10/2014 | Hill | E02F 3/3663 91/1 |
| 9,145,659 | B2 * | 9/2015 | Walz | E02F 9/2207 |
| 9,228,314 | B2 * | 1/2016 | Robi | F15B 13/07 |
| 10,113,292 | B2 * | 10/2018 | Yokota | E02F 3/3663 |
| 11,091,899 | B1 * | 8/2021 | Kenkel | E02F 9/2207 |
| 2006/0179831 | A1 | 8/2006 | Anderson et al. | |
| 2017/0130739 | A1 | 5/2017 | Zhang et al. | |
| 2018/0180068 | A1 | 6/2018 | Fukuda et al. | |
| 2020/0217040 | A1 * | 7/2020 | Hill | F16L 37/62 |

* cited by examiner

PIN ACTUATION SYSTEM AND METHOD

FIELD

Embodiments described herein relate to systems and methods for operation and control of a work vehicle. More particularly, the embodiments described herein relate to a system and method for actuating a pin hydraulic cylinder of a work vehicle.

SUMMARY

In many construction and agricultural equipment applications, for instance, being able to quickly and/or efficiently change between implements can be crucial to job site performance. Quick couplers can allow the operator to exchange implements, such as buckets, forks, brushes, or the like, without the operator being required to leave the cab of the work vehicle or otherwise intervene.

Such work vehicles may utilize a hydraulic system to actuate locking pins of a coupling mechanism located, for instance, at a distal end of a boom of the work vehicle. The quick couplers on such a vehicle may utilize a pin hydraulic cylinder to engage and disengage the locking pins that secure an implement to the work vehicle.

Debris may accumulate on the implement, the locking pins, and/or other components, which can increase the difficulty of coupling the implement to the boom of the work vehicle. The pin hydraulic cylinder is not included in the load sensing circuit of the hydraulic system, so it is unable to directly command the pump to increase hydraulic pressure to combat an increased coupling/decoupling difficulty caused by debris. Because the pin hydraulic cylinder is not included in the load sensing circuit or otherwise configured to directly command the pump, the pump outlet pressure will remain at a lower level than technically feasible. Operating the pin hydraulic cylinder at an insufficient pressure can degrade performance of components of the work vehicle.

Some work vehicles may be arranged such that a user could deadhead one of the functions of the hydraulic system in order to boost the hydraulic pressure to the pin hydraulic cylinder. To "deadhead" means shutting off a pump's ability to discharge fluid by closing a valve. If the hydraulic system does not include a safety mechanism and/or if the operator does not pay close attention, deadheading the pump can irreparably damage the pump.

To address at least some of the above concerns, embodiments described herein provide systems and methods for operating a work vehicle to actuate a pin hydraulic cylinder.

The present disclosure includes a system for operating a work vehicle. The system includes a hydraulic control assembly and a controller operatively coupled thereto. The hydraulic control assembly includes a pump, an accumulator, at least one boom hydraulic cylinder, at least one pin hydraulic cylinder, a pin control valve, and a ride control valve assembly. The pump includes a pump inlet and a pump outlet. The accumulator is in selective fluid communication with the pump. The boom hydraulic cylinder is in selective fluid communication with at least one of the pump outlet and the accumulator. The boom hydraulic cylinder actuates a boom of the work vehicle. The pin hydraulic cylinder is in selective fluid communication with the pump outlet. The pin hydraulic cylinder actuates a connection pin of the boom. The pin control valve selectively fluidly communicates the pump outlet with the pin hydraulic cylinder. The ride control valve assembly is in fluid communication with the pump and includes a charge valve and a discharge valve. The charge valve has a charge valve inlet and a charge valve outlet. The charge valve inlet is in fluid communication with the pump outlet. The charge valve outlet is in fluid communication with the accumulator and in fluid communication with the pump inlet. The discharge valve selectively fluidly communicates the accumulator with a reservoir. The controller operates to, in a pin actuation mode, open the charge valve with the discharge valve closed, and direct hydraulic fluid through the pin control valve.

The present disclosure includes a system for operating a work vehicle. The system includes a user interface, a hydraulic control assembly, and a controller operatively coupled to each of the user interface and the hydraulic control assembly. The user interface includes controls that are able to command at least some operations of the work vehicle. The hydraulic control assembly includes a pump, a boom hydraulic cylinder, a ride control valve assembly, and a pin hydraulic cylinder. The ride control valve assembly selectively supplies pressurized hydraulic fluid to the boom hydraulic cylinder. The ride control valve assembly includes a charge valve. The pin hydraulic cylinder selectively receives pressurized hydraulic fluid from the pump. The controller operates to receive a user command via the controls to initiate a ride control operation, supply pressurized hydraulic fluid to the boom hydraulic cylinder from the ride control valve assembly to perform the ride control operation, receive a user command via the controls to initiate a pin actuation, open the charge valve without supplying pressurized hydraulic fluid to the boom hydraulic cylinder from the ride control valve assembly (such that the ride control operation is not performed), thereby causing the pump to produce pressurized hydraulic fluid in a loop, and supply pressurized hydraulic fluid to the pin hydraulic cylinder from the loop to actuate the pin hydraulic cylinder.

The present disclosure includes a method of operating a work vehicle. The method includes receiving a user command to initiate a ride control operation, supplying pressurized hydraulic fluid to a boom hydraulic cylinder through a ride control valve assembly, receiving a user command to initiate a pin actuation, operating a portion of the ride control valve assembly without supplying pressurized hydraulic fluid to the boom hydraulic cylinder through the ride control valve assembly, and supplying pressurized hydraulic fluid to a pin hydraulic cylinder.

Before any embodiments are explained in detail, it is to be understood that the embodiments are not limited in their application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers" and "computing devices" described in the specification can include one or more processing units, one or more computer-readable medium modules, one or more input/output interfaces, and various connections (e.g., a system bus) connecting the components.

Other aspects of the embodiments will become apparent by consideration of the detailed description and accompanying drawings.

DETAILED DESCRIPTION

Some work vehicles include a ride control feature. Ride control is often used in work vehicles having a front-end boom. The ride control feature is meant to counteract loads or external forces on the work vehicle which may cause oscillation of the work vehicle or of components thereof. Such oscillations may occur while, for instance, the work vehicle drives across a surface that is uneven. The ride control feature controls certain components of the hydraulic system, such as hydraulic cylinders and valves fluidly coupled to accumulators, to selectively move in a manner that counteracts and/or dampens the oscillations.

In work vehicles having a ride control feature, an opportunity arises to utilize the preexisting hydraulic system to perform an automatic pin hydraulic cylinder pressure boost.

Figure 1:
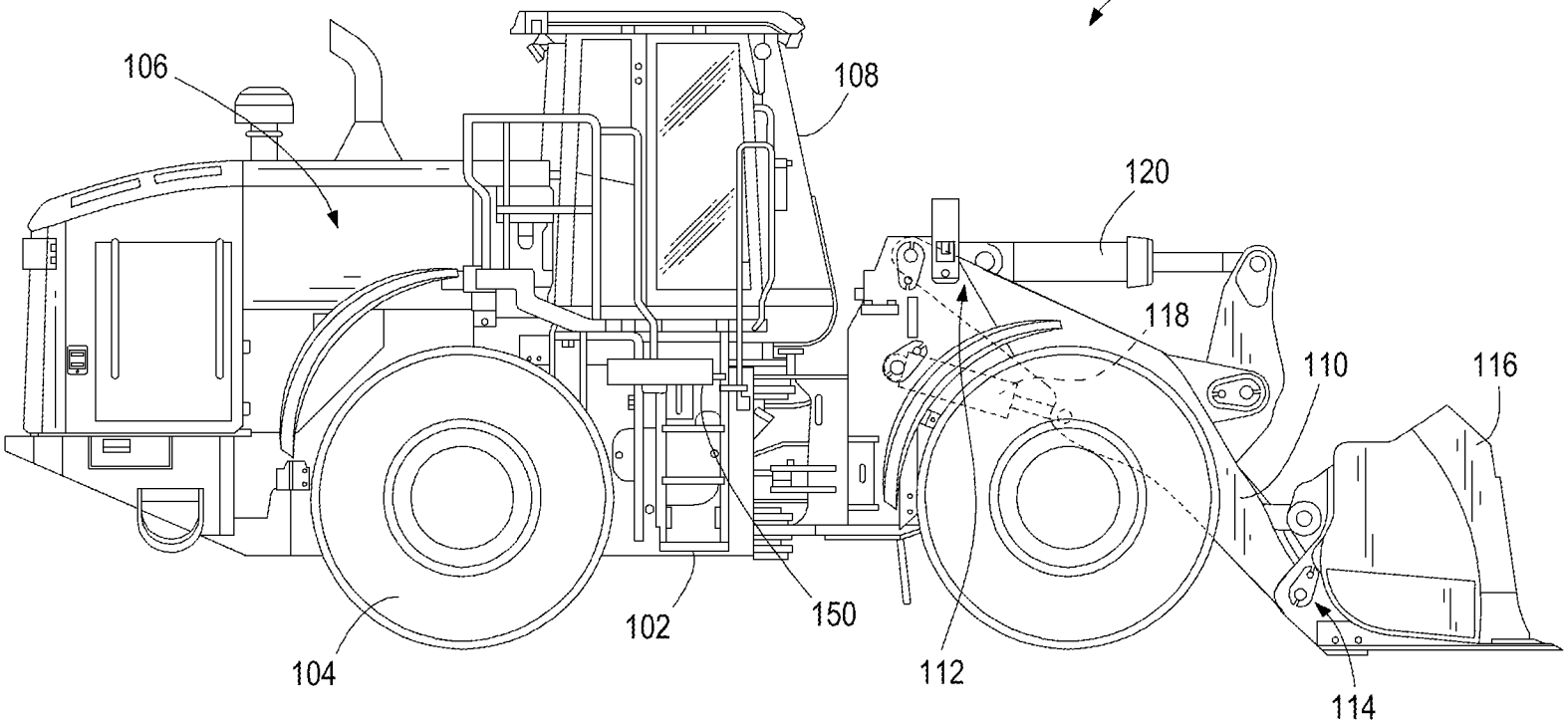
FIG. 1 illustrates a work vehicle, according to embodiments described herein.

FIG. 1 illustrates an example embodiment of a work vehicle 100. The work vehicle 100 is illustrated as a wheel loader in this embodiment, but the work vehicle 100 could be any type of work vehicle having a hydraulic system, such as a backhoe, a skid steer, or the like. The work vehicle 100 includes a chassis 102 to provide structure and support to the components of the work vehicle 100.

The work vehicle 100 travels along a ground surface via four wheels 104 in the illustrated embodiment. Of course, other ground-engaging structures are contemplated herein, such as tracks, for instance. The number of ground-engaging structures may vary from the example embodiment, as well.

The work vehicle 100 further includes an engine 106 to power the work vehicle 100 and drive the work vehicle 100 forward. The work vehicle 100 also includes an operator station 108 in the form of a cab connected to the chassis 102. In other embodiments, however, a user interface may be located remote from the work vehicle 100 for user operation via, for instance, a computer (described in more detail below).

A boom 110 is disposed at the front end of the work vehicle 100. The boom 110 includes multiple rigid members pivotally coupled to each other and ultimately coupled to the chassis 102 at a proximal end 112 of the boom 110. The boom 110 further includes a distal end 114 opposite the proximal end 112. The distal end 114 of the boom 110 is configured to removably couple to one or more implements 116. In the illustrated embodiment, the implement 116 is shown as a bucket, but other implements are contemplated herein, such as one or more forks/tines, brushes, blades, or the like. The boom 110 and implement 116 are actuated by a hydraulic control assembly, which includes, for instance, one or more hydraulic pumps, cylinders, valves, and plumbing (described in more detail below). As shown in FIG. 1, the illustrated embodiment has a hydraulic control assembly that includes one or more boom cylinders 118 and one or more implement cylinders 120.

Figure 2:
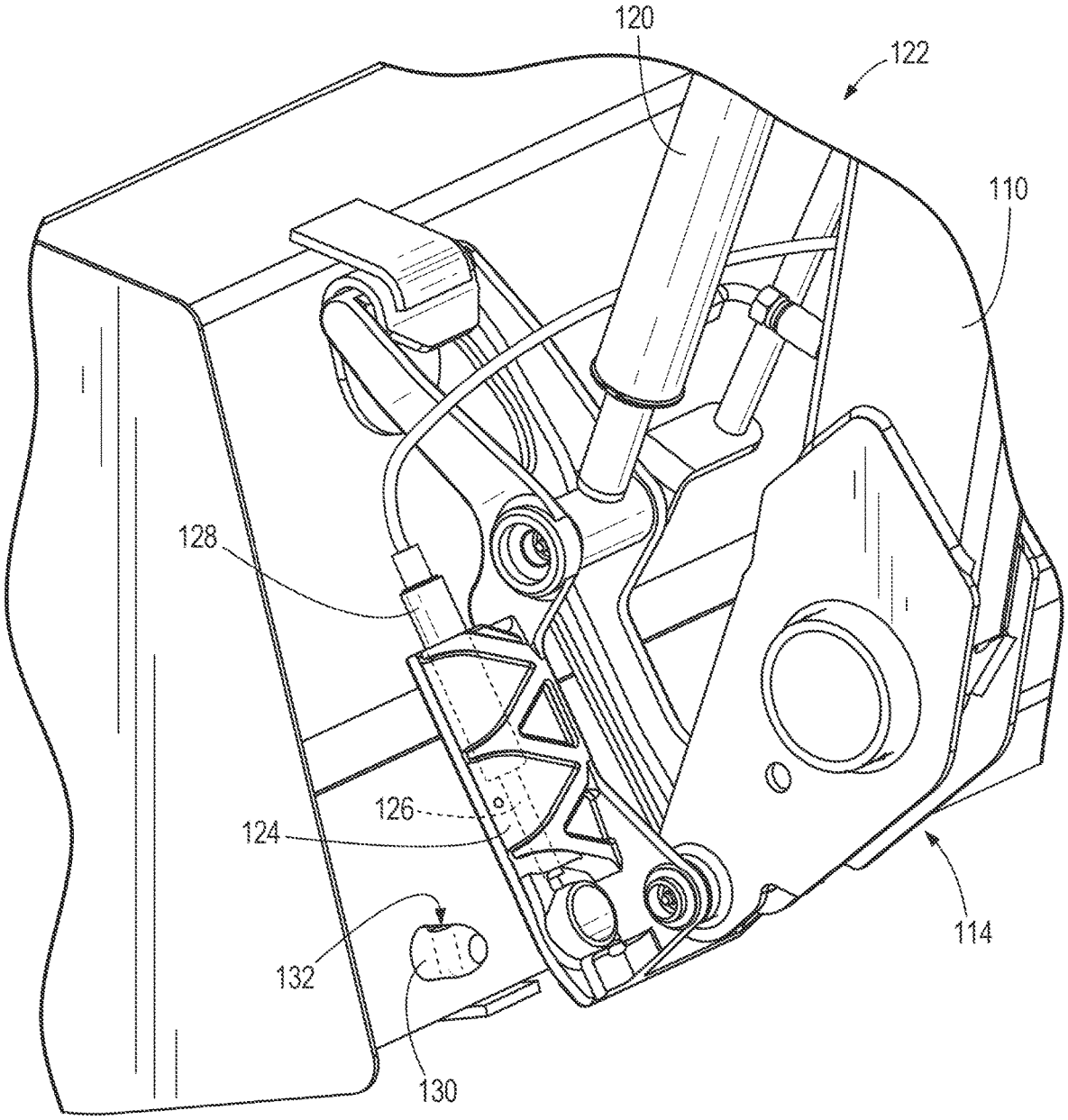
FIG. 2 illustrates a quick-couple assembly of the work vehicle of FIG. 1.

FIG. 2 illustrates an example of a quick-couple assembly 122. The quick-couple assembly 122 includes one or more attachment brackets 124 disposed on or about the distal end 114 of the boom 110. One or more pins 126 are hydraulically actuated by their respective pin cylinder 128. The pin cylinder 128 may be fluidly coupled to and/or included as a part of the same hydraulic control assembly mentioned above, for instance. The pin cylinder 128 actuates the pin 126 from a disengaged position (shown in FIG. 2) to an extended engaged position. In the engaged position, the pin 126 extends through a protrusion 130 of the implement 116 via an aperture 132 to connect the boom 110 to the implement 116.

Figure 3:
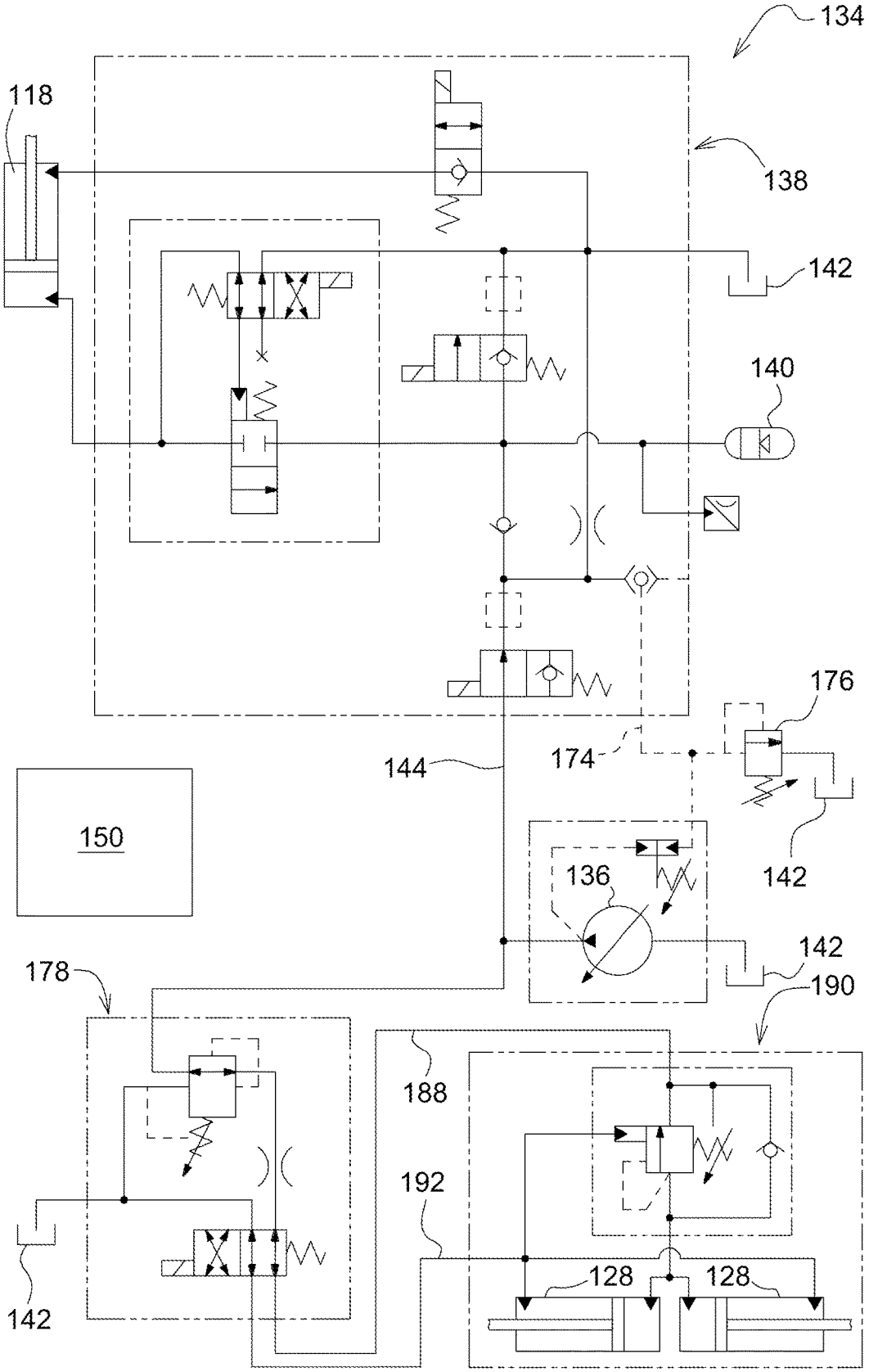
FIG. 3 schematically illustrates a hydraulic control assembly of a work vehicle, according to embodiments described herein.

FIG. 3 schematically illustrates the hydraulic control assembly mentioned above and indicated generally at 134. The hydraulic control assembly 134 includes various components, only some of which are described herein for the sake of brevity. As shown in FIG. 3, the hydraulic control assembly 134 includes, for instance, the boom cylinder 118, and the pin cylinder 128 discussed above. The hydraulic control assembly 134 also includes a pump 136, a ride control valve assembly 138, an accumulator 140, and a reservoir 142.

The ride control valve assembly 138 is fluidly coupled to the boom cylinder 118 to control the flow of hydraulic fluid to and from the head and rod ends of the boom cylinder 118. The ride control valve assembly 138 is also fluidly coupled to the accumulator 140 and the reservoir 142. The ride control valve assembly 138 allows hydraulic fluid to move between the boom cylinder 118 and the accumulator 140, which permits the boom cylinder 118 to extend and retract in a limited fashion. This extending and retracting moves the boom 110 relative to the chassis 102, which allows the mass of the implement 116, the boom 110, and any payload on/in the implement 116 to float relative the chassis 102. This floating operation allows the mass to act as a dynamic counterweight, thereby dampening oscillations of the work vehicle 100 caused by, for instance, uneven surface conditions over which the work vehicle 100 is traveling.

As shown in FIG. 3, the ride control valve assembly 138 receives pressurized hydraulic fluid from the outlet of the pump 136, which draws hydraulic fluid from the reservoir 142 and provides it to the ride control valve assembly via line 144.

Figure 3A:
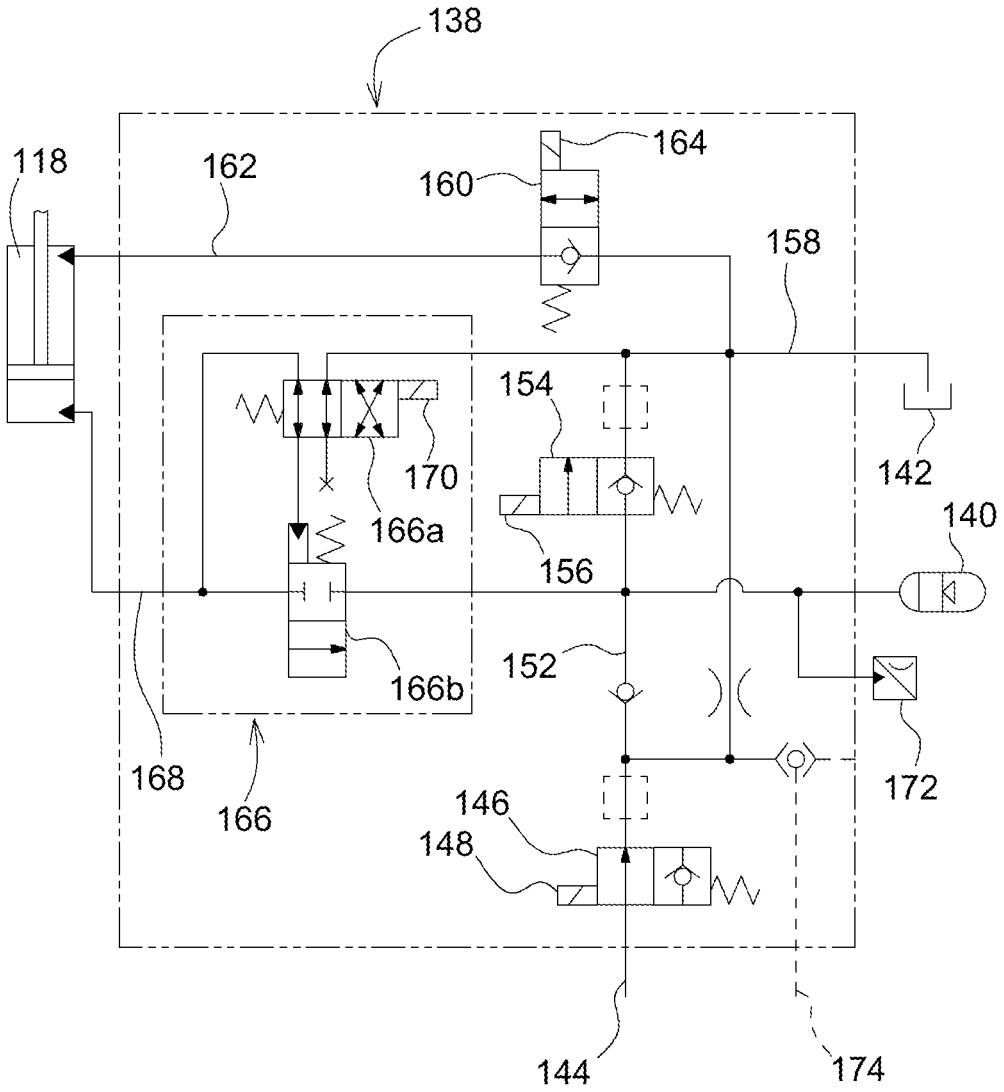
FIG. 3A schematically illustrates a ride control valve assembly of the hydraulic control assembly of FIG. 3.

With particular reference to FIG. 3A, which is a detailed view of the upper portion of FIG. 3, the pressurized hydraulic fluid supplied via line 144 is received by a charge valve 146 at its inlet. The inlet of the charge valve 146 is schematically represented by the bottom edge of the charge valve 146 in FIG. 3A, while an outlet of the charge valve 146 is schematically represented by the top edge of the charge valve 146. The inlet and outlet of the charge valve 146 are fluidly decoupled when the charge valve 146 is in a closed position (schematically illustrated by the one-way valve block of the charge valve 146 in FIG. 3). The charge valve 146 is in an open position in FIG. 3, which means the inlet and outlet are fluidly coupled and allow hydraulic fluid to pass therethrough. The charge valve 146 can be actuated by a solenoid 148, which in turn can be actuated by the application of current from a controller 150 (shown in FIG. 3 and described in more detail below). The outlet of the charge valve 146 is fluidly coupled to line 152, which itself is fluidly coupled to the accumulator 140. The state or position of the charge valve 146 thereby controls the charging of the accumulator 140 by allowing or inhibiting the pump 136 to draw hydraulic fluid from the reservoir 142 and pump it into the accumulator 118. While the charge valve 146 controls the charging of the accumulator 140 by the pump 136, it should be understood that the accumulator 140 is fluidly coupled to multiple other components in the ride control valve assembly 138, such that the net charging or discharging effect on the accumulator 140 is controlled by multiple components, pressures, and flows.

The accumulator 140 is fluidly coupled to both the outlet of the charge valve 146 as well as an inlet of a discharge valve 154 via the line 152. The inlet of the discharge valve 154 is schematically represented by the bottom edge of the discharge valve 154 in FIG. 3A. Stated another way, the outlet of the charge valve 146 is fluidly coupled to both the inlet of the discharge valve 154 and the accumulator 140. The discharge valve 154 also includes an outlet, which is schematically represented by the top edge of the discharge valve 154 in FIG. 3A. The inlet and the outlet of the discharge valve 154 are fluidly decoupled when the discharge valve 154 is in a closed position (schematically illustrated as the one-way valve block in FIG. 3A). When the discharge valve 154 is in an open position (not illustrated, but represented by the upward pointing arrow block in FIG. 3A), the inlet and outlet are fluidly coupled to allow hydraulic fluid to pass therethrough. The discharge valve 154 can be actuated by a solenoid 156, which in turn can be actuated by the application of current from the controller 150 (shown in FIG. 3). The outlet of the discharge valve 154 is fluidly coupled to line 158, which is fluidly coupled to the reservoir 142.

The line 158 is also fluidly coupled to an outlet of a rod ride control valve 160, which is schematically represented by the right edge of the rod ride control valve 160 in FIG. 3A. The inlet of the rod ride control valve 160 (schematically represented by the left edge of the rod ride control valve 160 in FIG. 3A) is fluidly coupled to line 162, which itself is fluidly coupled to the rod end of the boom cylinder 118. With the rod ride control valve 160 in a closed position as illustrated in FIG. 3A, the inlet and outlet are fluidly decoupled. With the rod ride control valve 160 in an open position (not illustrated, but represented by the double-headed arrow block of the rod ride control valve 160), the inlet and outlet are fluidly coupled to allow hydraulic fluid to flow between the rod side of the boom cylinder 118 and the reservoir 142. The rod ride control valve 160 can be actuated by a solenoid 164, which in turn can be actuated by the application of current from the controller 150 (shown in FIG. 3). With the ride control feature/mode active, the solenoid 164 opens the rod ride control valve 160, thereby allowing the boom cylinder 118 to extend and/or retract.

The ride control valve assembly 138 also includes a head ride control valve 166. An inlet of the head ride control valve 166 (schematically represented by the left edge of the head ride control valve 166) is fluidly coupled to line 168, which itself is fluidly coupled to the head end of the boom cylinder 118. An outlet of the head ride control valve 166 (schematically represented by the right edge of the head ride control valve 166) is fluidly coupled to line 152. Stated another way, the outlet of the head ride control valve 166 is fluidly coupled to the accumulator 140, the outlet of the charge valve 146, and the inlet of the discharge valve 154. The inlet and the outlet of the head ride control valve 166 are illustrated in the closed position in FIG. 3A, which means the inlet and outlet are fluidly decoupled. With the head ride control valve 166 in the open position (not illustrated, but schematically represented by the right pointing arrow block of the ride control valve 166), the inlet and outlet are fluidly coupled, thereby allowing hydraulic fluid to pass therethrough. The head ride control valve 166 can be actuated by a solenoid 170, which in turn can be actuated by the application of current from the controller 150 (shown in FIG. 3). More specifically, actuation of the solenoid 170 shifts a first spool 166*a*, thereby changing a first pilot pressure on a second spool 166*b* from being supplied by the head end of the boom cylinder 118 via line 168 to instead being supplied by the reservoir 142 via line 158. The second spool 166*b* experiences the first pilot pressure acting to close the second spool 166*b* and experiences a second pilot pressure supplied by line 168 to open the second spool 166*b*. Actuation of the solenoid 170, therefore, permits the second spool 166*b* to move to an open position if the pressure in the head side of the boom cylinder 118 is above a threshold pressure. With the ride control feature/mode active, the solenoid 170 actuates the head ride control valve 166 to selectively allow fluid coupling between the head side of the boom cylinder 118 and the accumulator 140. Of course, the illustrated embodiment represents only one system capable of executing a ride control feature/mode. Other systems and assemblies capable of executing a ride control feature/mode are also contemplated herein.

As shown in FIG. 3, the hydraulic control assembly 134 further includes a return line 174 fluidly coupled to the ride control valve assembly 138. In the illustrated embodiment, the return line 174 is fluidly coupled to line 152. Stated another way, the return line 174 is fluidly couples to outlet of the charge valve 146. The hydraulic control assembly 134 also includes a pressure reduction valve 176 fluidly coupled to return line 174. The pressure reduction valve 176 opens once the pressure in the return line 174 and, therefore, the line 152 is above a threshold pressure (for instance, 3320 pounds per square inch or 22.9 megapascals). If the threshold pressure is reached, the pressure reduction valve 176 opens and releases some of the hydraulic fluid to the reservoir 142.

Also shown in FIG. 3, the return line 174 is further fluidly coupled to the pump 136. The pump 136 is capable of drawing hydraulic fluid from one or both of the return line 174 and the reservoir 142. If the charge valve 146 is open, a loop is formed flowing through the pump 136, through line 144, through the charge valve 146, through line 152, through return line 174, and back through the pump 136. The pump 136 pressurizes the hydraulic fluid in order to charge the accumulator 140 while the discharge valve 154 is closed. Because of the threshold pressure of the pressure reduction valve 176 and because of the margin pressure of the pump 136, the pump 136 outputs a hydraulic pressure at its outlet that is above the threshold pressure. In some embodiments, the margin pressure is about 305 pounds per square inch (2.1 megapascals), for instance. This example arrangement would produce a pressure of about 3625 pounds per square inch (25 megapascals), for instance, at the outlet of the pump 136.

Figure 3B:
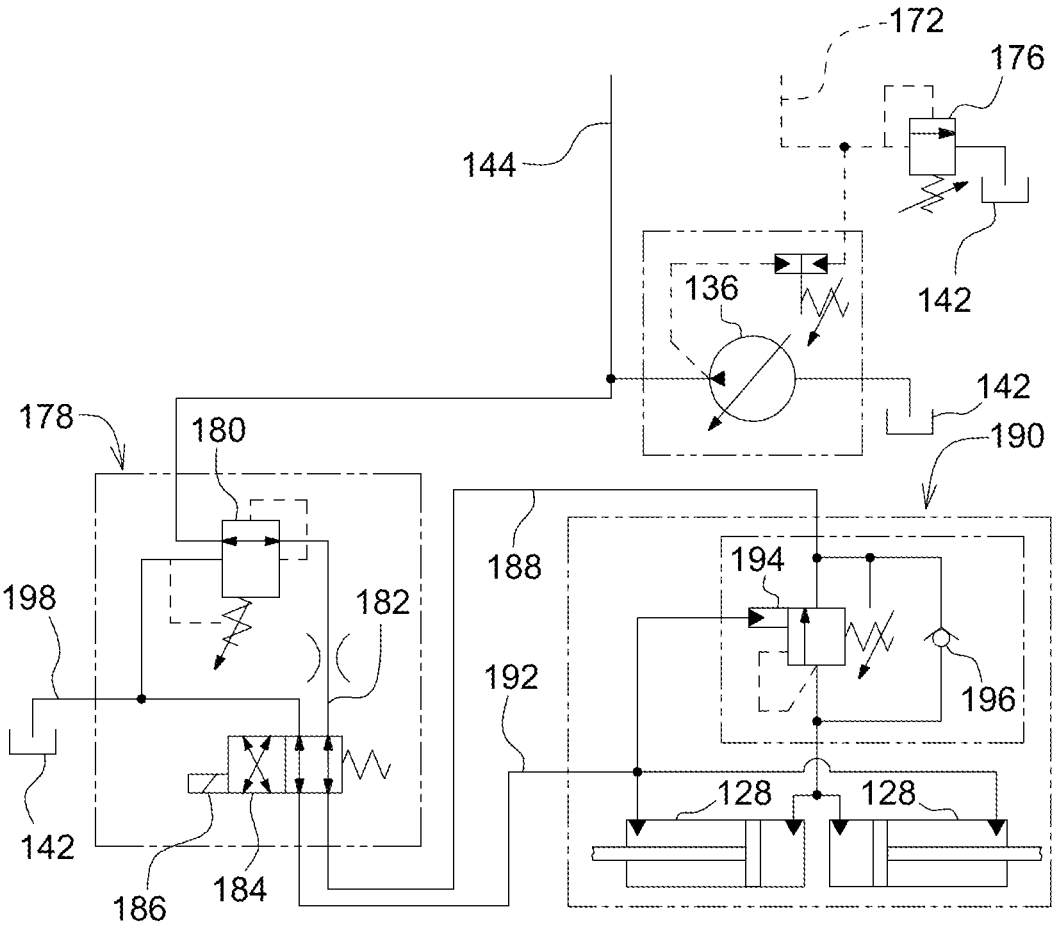
FIG. 3B schematically illustrates a pump and pin control valve assembly of the hydraulic control assembly of FIG. 3.

Turning now to FIG. 3B, which is a detailed view of the lower portion of FIG. 3, the line 144 leaving the outlet of the pump 136 is also fluidly coupled to a pin control valve assembly 178. The pin control valve assembly 178 includes a pressure reduction valve 180 fluidly coupled to line 144. The pressure reduction valve 180 of the pin control valve assembly 178 is open when the pressure in the line 182 is below the threshold pressure (for instance, 2000 pounds per square inch or 13.8 megapascals). If the threshold pressure is reached, the pressure reduction valve 180 begins to close to limit the pressure to the threshold pressure downstream in the line 182. This pressure reduction valve 180 prevents damage to the pin cylinder 128 and/or components of the pin control valve assembly 178. Although not illustrated, one or more controllable valves may be located between the pump 136 and the pressure reduction valve 180 so as to prevent pressurized hydraulic fluid from escaping the loop described above when the pin 126 is not being actuated, for instance.

Downstream from the pressure reduction valve 180 is a line 182 fluidly coupled to an inlet of a pin control valve 184. The inlet of the pin control valve 184 is schematically represented by a portion the top edge and a portion of the bottom edge of the pin control valve 184 in FIG. 3B, while the outlet of the pin control valve 184 is schematically represented by a portion of the bottom edge and a portion of the top edge of the pin control valve 184. The inlets and outlets of the pin control valve 184 are fluidly coupled in two alternative arrangements, represented by each of the valve blocks of the pin control valve 184 in FIG. 3B. The right valve block having two parallel double-headed arrows represents a position of the pin control valve 184 that directs hydraulic fluid to extend the pin 126 from the pin cylinder 128. The left valve block having two crossed double-headed arrows represents a position of the pin control valve 184 that directs hydraulic fluid to retract the pin 126 toward the pin cylinder 128. The pin control valve 184 can be actuated by a solenoid 186, which in turn can be actuated by the application of current from a controller 150 (shown in FIG. 3). Although not illustrated, some embodiments may include a third block of the pin control valve 184 that closes the pin control valve 184 completely, that is to say the inlets and outlets of the pin control valve 184 are fluidly decoupled. The state or position of the pin control valve 184 thereby controls the actuation of the pin cylinder 128 and, thereby, the pin 126 (as will be described further below).

A line 188 extends from the outlet of the pin control valve 184 and fluidly couples the outlet of the pin control valve 184 to a pin actuation assembly 190. Another line 192 also extends from the outlet of the pin control valve 184 and fluidly couples the outlet of the pin control valve 184 to the pin actuation assembly 190. The pin actuation assembly 190 includes a spool 194, a one-way check valve 196, and at least one pin cylinder 128 (two are shown in FIG. 3B). The outlet of the spool 194 (schematically represented by the top edge of the spool 194 in FIG. 3B) is fluidly coupled to the line 188. The inlet of the one-way check valve 196 is also fluidly coupled to the line 188.

When hydraulic fluid is directed from the pressure reduction valve 180, through the pin control valve 184, and into the line 188, the hydraulic fluid bypasses the spool 194 and travels through the one-way check valve 196 to ultimately enter the head end of the pin cylinder 128. As the pressure due to the hydraulic fluid in the head end of the pin cylinder 128 increases, the pin 126 is then extended outwardly from the pin cylinder 128. As long as the hydraulic force on the head end of the pin cylinder 128 is higher than the hydraulic force on the rod end of the pin cylinder 128, the pin 126 will continue to extend outwardly (until a physical limit is reached or until the operation is stopped). This movement will cause the hydraulic fluid in the rod end of the pin cylinder 128 to be evacuated via line 192, through the pin control valve 184, and through line 198 to the reservoir 142.

When hydraulic fluid is directed from the pressure reduction valve 180, through the pin control valve 184, and into line 192, the hydraulic fluid enters the rod end of the pin cylinder 128. The hydraulic fluid also causes a pilot pressure to act to open the spool 194, which allows hydraulic fluid to escape the head end of the pin cylinder 128 through the spool 194, through line 188, through the pin control valve 184, and through line 198 to the reservoir 142 (as long as the hydraulic force on the rod end of the pin cylinder 128 is higher than the hydraulic force on the head end of the pin cylinder 128, until a physical limit is reached or until the operation is stopped). This transfer of hydraulic fluid causes the pin 126 to retract inwardly toward the pin cylinder 128.

The hydraulic control assembly 134 may also include multiple pressure sensors to monitor the hydraulic pressures at certain points throughout the hydraulic control assembly 134. Such sensors can include a head side sensor (not shown) monitoring the hydraulic pressure on the head side of the boom cylinder 118, an accumulator sensor 172 detecting the hydraulic pressure of the accumulator 140 and/or line 152, or the like. Each sensor is operatively coupled to the controller 150 such that signals indicative of the detected pressure may be monitored by the controller 150. In some embodiments, these sensors may be combined pressure and temperature sensors.

With the above described arrangement, the actuation of the pin 126 can be boosted with a higher hydraulic pressure than would normally be available. To accomplish this boosted hydraulic pressure, the charge valve 146 of the ride control valve assembly 138 can be opened to cause the pump 136 to pressurize the loop described above. The pressurized hydraulic fluid in the loop can be used to supply boosted hydraulic pressure to the pin cylinder 128. In fact, the present arrangement, in some embodiments, includes the pressure reduction valve 180 to avoid damage to components such as the pin control valve 184 and the pin actuation assembly 190.

A user input can be programmed or labeled for pin actuation, but will include opening the charge valve 146 of the ride control valve assembly 138 while no ride control feature/mode is enabled. In this manner, the user need not know the particulars of how the boosted pressure is supplied to the pin cylinder 128 and need not perform tasks that might require specific expertise or careful attention (aside from conventional work vehicle 100 operation). This boosted pressure to the pin cylinder 128 can allow for effective actuation of the pin 126 (either the connection actuation or the disconnection actuation) with an adequate pressure to overcome debris that may be present, for instance, in the aperture 132 of the protrusion 130 of the implement 116.

Figure 4:
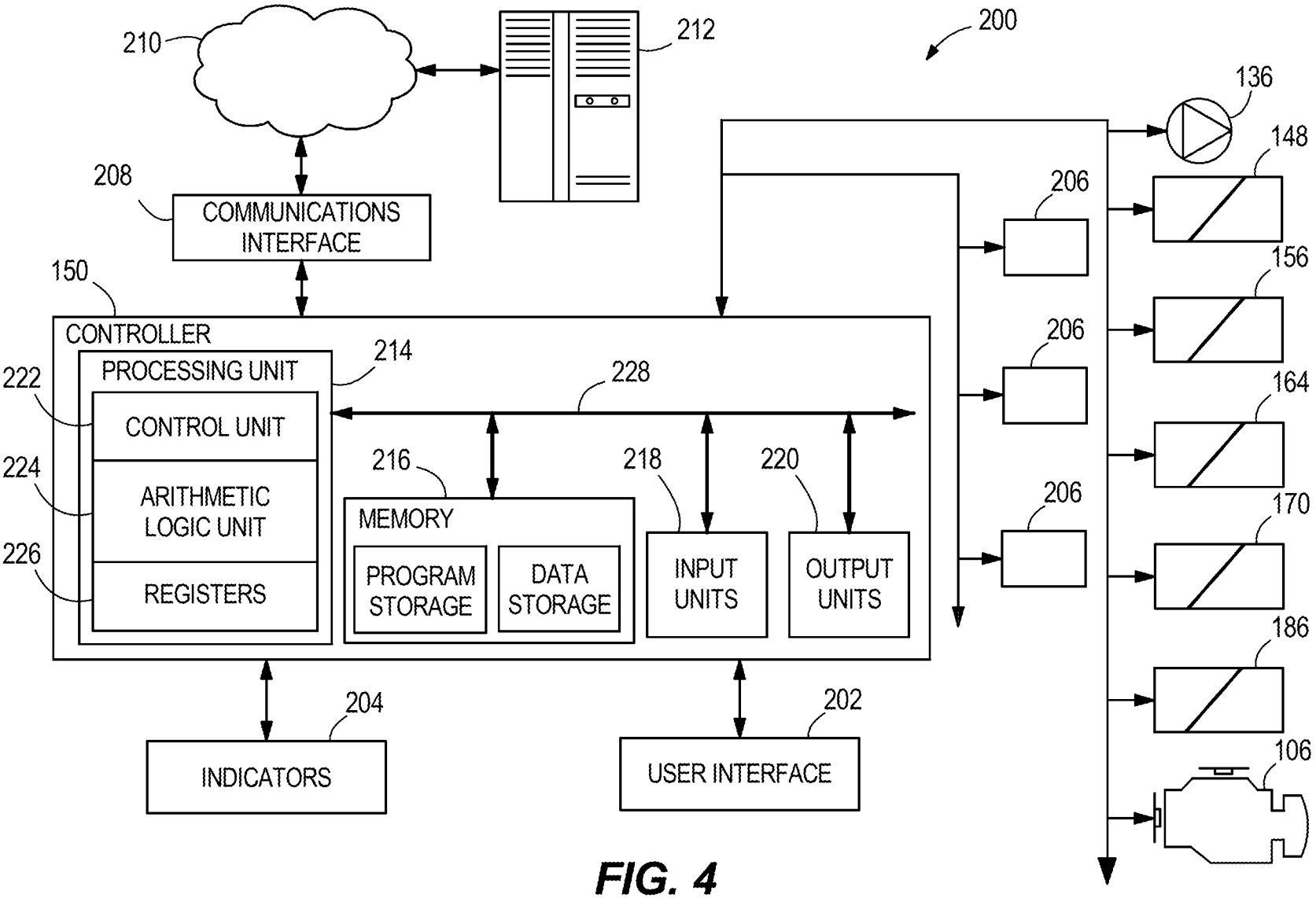
FIG. 4 schematically illustrates a system for operating a work vehicle, according to embodiments described herein.

With reference to FIG. 4, the work vehicle 100 also includes the controller 150 as part of a control system 200 of the work vehicle 100. As shown in FIG. 4, the control system 200 includes controls as part of a user interface 202, which may be located remotely from the work vehicle 100 or which may be disposed on or in the work vehicle 100, such as on or in the operator station and/or cab 108 of FIG. 1.

In embodiments including controls in the operator station and/or cab 108, the controls may include a steering wheel, one or more levers, one or more buttons, one or more switches, some combination thereof, or the like. Some embodiments may further include the inputs from a user received by the controller 150, where the controller 150 itself commands the respective components of the work vehicle 100.

As shown in FIG. 4, the control system 200 may also include indicators 204, one or more sensors 206 (which may include, for instance, accumulator sensor 172), the pump 136, one or more solenoids (including, for instance, solenoids 148, 156, 164, 170, 186), the engine 106, or the like.

In some embodiments, the control system 200 further includes a communications interface 208 configured to communicatively couple the controller 150 via, for instance, a network 210 to a server 212. The connections between the user interface 202 and the controller 150 and/or the indicators 204 and the controller 150 may also be via the network 210 in some embodiments. The connections between the user interface 202 and the controller 150 and/or the indicators 204 and the controller 150 are, for example, wired connections, wireless connections, or a combination of wireless and wired connections. Similarly, any of the connections between the various components of the control system 200 are wired connections, wireless connections, or a combination of wireless and wired connections.

The network 210 is, for example, a wide area network ("WAN") (e.g., a TCP/IP based network), a local area network ("LAN"), a neighborhood area network ("NAN"), a home area network ("HAN"), or personal area network ("PAN") employing any of a variety of communications protocols, such as Wi-Fi, Bluetooth, ZigBee, etc. In some implementations, the network 210 is a cellular network, such as, for example, a Global System for Mobile Communications ("GSM") network, a General Packet Radio Service ("GPRS") network, a Code Division Multiple Access ("CDMA") network, an Evolution-Data Optimized ("EV-DO") network, an Enhanced Data Rates for GSM Evolution ("EDGE") network, a 3GSM network, a 4GSM network, a 4G LTE network, a 5G New Radio, a Digital Enhanced Cordless Telecommunications ("DECT") network, a Digital AMPS ("IS-136/TDMA") network, or an Integrated Digital Enhanced Network ("iDEN") network, etc.

FIG. 4 also illustrates various portions of the controller 150. The controller 150 is electrically and/or communicatively connected to a variety of modules or components of the system 200. For example, the illustrated controller 150 is connected to one or more indicators 204 (e.g., LEDs, a liquid crystal display ["LCD"], other visual indicators, a speaker, other audio indicators, a vibration motor, other tactile indicators, some combination thereof, etc.), a user interface or controls 202, and the communications interface 208. The communications interface 208 is connected to the network 210 to enable the controller 150 to communicate with the server 212. The controller 150 includes combinations of hardware and software that are operable to, among other things, control the operation of the system 200 including various components of the work vehicle 100 such as the one or more sensors 206 (which may include, for instance, accumulator sensor 172), the pump 136, one or more solenoids (including, for instance, solenoids 148, 156, 164, 170, 186), the engine 106, or the like.

The controller 150 further includes combinations of hardware and software that are operable to receive one or more signals from the one or more sensors 206 (which may include, for instance, accumulator sensor 172), communicate over the network 210, receive input from a user via the user interface 202, provide information to a user via the indicators 204, etc. In some embodiments, the indicators 204 may be integrated into the user interface 202 in the form of, for instance, a touch-screen. Examples of user interfaces include, but are not limited to, a personal or desktop computer, a laptop computer, a tablet computer, or a mobile phone (e.g., a smart phone).

In some embodiments, the controller 150 is included within the user interface 202, and, for example, the controller 150 can provide control signals directly to the one or more sensors 206 (which may include, for instance, accumulator sensor 172), the pump 136, one or more solenoids (including, for instance, solenoids 148, 156, 164, 170, 186), the engine 106, or the like and receive signals directly from the one or more sensors 206 (which may include, for instance, accumulator sensor 172). In other embodiments, the controller 150 is associated with the server 212 and communicates through the network 210 to provide control signals and receive sensor signals.

The controller 150 includes a plurality of electrical and electronic components that provide power, operational control, and protection to the components and modules within the controller 150 and/or the system 200. For example, the controller 150 includes, among other things, a processing unit 214 (e.g., a microprocessor, a microcontroller, or another suitable programmable device), a memory 216, input units 218, and output units 220. The processing unit 214 includes, among other things, a control unit 222, an arithmetic logic unit ("ALU") 224, and a plurality of registers 226 (shown as a group of registers in FIG. 4), and is implemented using a known computer architecture (e.g., a modified Harvard architecture, a von Neumann architecture, etc.). The processing unit 214, the memory 216, the input units 218, and the output units 220, as well as the various modules or circuits connected to the controller 150 are connected by one or more control and/or data buses (e.g., common bus 228). The control and/or data buses are shown generally in FIG. 4 for illustrative purposes. The use of one or more control and/or data buses for the interconnection between and communication among the various modules, circuits, and components would be known to a person skilled in the art in view of the embodiments described herein.

The memory 216 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 214 is connected to the memory 216 and executes software instructions that are capable of being stored in a RAM of the memory 216 (e.g., during execution), a ROM of the memory 216 (e.g., on a generally permanent basis), or another non-transitory computer readable medium such as another memory or a disc. Software included in the implementation of the system 200 and controller 150 can be stored in the memory 216 of the controller 150. The software includes, for example, firmware, one or more applications, program data, filters, rules, one or more program modules, and other executable instructions. The controller 150 is configured to retrieve from the memory 216 and execute, among other things, instructions related to the control processes and methods described herein. In other embodiments, the controller 150 includes additional, fewer, or different components.

The controls of the user interface 202 are included to provide user control of the system 200. The user interface 202 is operably coupled to the controller 150 to control, for example, the pump 136, one or more solenoids (including, for instance, solenoids 148, 156, 164, 170, 186), the engine 106, or the like. The user interface 202 can include any combination of digital and analog input devices required to achieve a desired level of control for the system 200. For example, the user interface 202 can include a computer having a display and input devices, a touch-screen display, a plurality of knobs, dials, switches, buttons, or the like.

Figure 5:
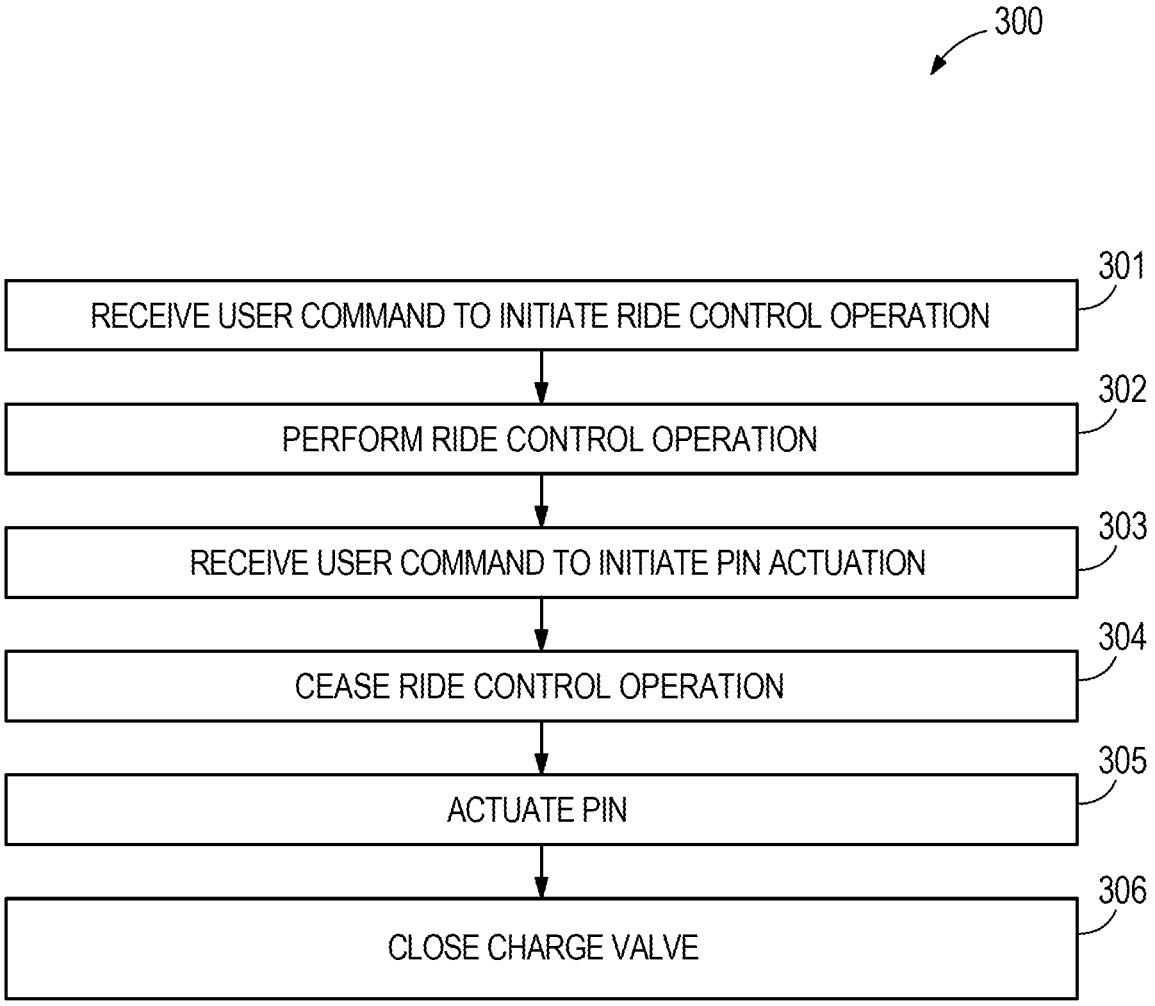
FIG. 5 illustrates a method of operating a work vehicle, according to embodiments described herein.

The system 200, including the work vehicle 100, is configured to operate according to the method 300 shown in FIG. 5. The method 300 begins with receiving a user command via the user interface 202 to initiate a ride control operation (at step 301). Then, the controller 150 operates at least one of the pump 136, the solenoids (including, for instance, solenoids 148, 156, 164, 170, 186), and the engine 106 to supply pressurized hydraulic fluid to the accumulator 140 through the ride control valve assembly 138, as well as fluidly communicating the accumulator 150 with the boom cylinder 118 as part of performing the ride control operation/mode (at step 302). In some embodiments, this step 302 further includes the controller 150 operating one or more solenoids (including, for instance, solenoids 148, 156, 164, 170, 186) to inhibit performance of a pin actuation during the ride control operation.

The method 300 further includes receiving a user command via the user interface 202 to initiate a pin actuation (at step 303). The controller 150 ceases the ride control operation (at step 304) by closing the discharge valve 154 but keeping the charge valve 146 open. The controller 150 then directs pressurized hydraulic fluid to the pin cylinder 128, thereby actuating the pin 126 (at step 305). Depending on the position of the pin control valve 184, the pin actuation may move the pin 126 to one of a pin disconnect position and a pin connect position.

In some embodiments, the method 300 further includes determining a completion of the pin actuation (by, for instance, detecting a stroke distance of the pin 126, a pressure level in the pin cylinder 128 or in another location in the hydraulic control assembly 134, detecting a certain amount of time has passed, or the like) and thereafter closing the charge valve 146 (at step 306). In some embodiments, the pump 136 may also be shut off or slowed as part of this step 306.

Some embodiments may further include the controller 150 detecting if the engine 106 is off and, if so, ignoring any user commands via the user interface 202 to initiate one or both of the pin actuation and the ride control operation.

Of course, features of one embodiment can be combined with features of another embodiment to create yet another embodiment. As such, the present disclosure is capable of many alterations and embodiments, and the specific disclosed embodiments should not be viewed as limiting.

Thus, embodiments described herein provide methods and systems for operating a work vehicle.

What is claimed is:

1. A system for operating a work vehicle, the system comprising:

a hydraulic control assembly including a pump including a pump inlet and a pump outlet, an accumulator in selective fluid communication with the pump, at least one boom hydraulic cylinder in selective fluid communication with at least one of the pump outlet and the accumulator, the boom hydraulic cylinder for actuating a boom of the work vehicle, at least one pin hydraulic cylinder in selective fluid communication with the pump outlet, the pin hydraulic cylinder for actuating a connection pin of the boom, a pin control valve selectively fluidly communicating the pump outlet with the pin hydraulic cylinder, and a ride control valve assembly in fluid communication with the pump, the ride control valve assembly including a charge valve having a charge valve inlet and a charge valve outlet, the charge valve inlet in fluid communication with the pump outlet, the charge valve outlet in fluid communication with the accumulator and in fluid communication with the pump inlet, a discharge valve selectively fluidly communicating the accumulator with a reservoir; and a controller operatively coupled to the hydraulic control assembly, the controller configured to, in a pin actuation mode, open the charge valve with the discharge valve closed, and direct hydraulic fluid through the pin control valve.

2. The system of claim 1, wherein the controller is further configured to, in a ride control mode, direct no hydraulic fluid through the pin control valve.

3. The system of claim 1, wherein directing hydraulic fluid through the pin control valve moves the pin hydraulic cylinder to a pin disconnect position.

4. The system of claim 1, wherein directing hydraulic fluid through the pin control valve moves the pin hydraulic cylinder to a pin connect position.

5. The system of claim 1, further comprising a pressure reduction valve downstream of the pump outlet and upstream of the pin control valve.

6. The system of claim 5, wherein, in the pin actuation mode, the pump supplies a common hydraulic pressure to the accumulator and to an inlet of the pressure reduction valve.

7. A system for operating a work vehicle, the system comprising:

a user interface including controls configured to command at least some operations of the work vehicle;

a hydraulic control assembly including a pump, a boom hydraulic cylinder, a ride control valve assembly configured to selectively supply pressurized hydraulic fluid to the boom hydraulic cylinder, the ride control valve assembly including a charge valve, and a pin hydraulic cylinder configured to selectively receive pressurized hydraulic fluid from the pump; and a controller operatively coupled to the user interface and to the hydraulic control assembly, the controller configured to receive a user command via the controls to initiate a ride control operation, supply pressurized hydraulic fluid to the boom hydraulic cylinder through the ride control valve assembly to perform the ride control operation, receive a user command via the controls to initiate a pin actuation, open the charge valve without supplying pressurized hydraulic fluid to the boom hydraulic cylinder from the ride control valve assembly such that the ride control operation is not performed, thereby causing the pump to produce pressurized hydraulic fluid in a loop, and supply pressurized hydraulic fluid to the pin hydraulic cylinder from the loop to actuate the pin hydraulic cylinder.

8. The system of claim 7, wherein actuating the pin hydraulic cylinder includes moving the pin hydraulic cylinder to a pin disconnect position.

9. The system of claim 7, wherein actuating the pin hydraulic cylinder includes moving the pin hydraulic cylinder to a pin connect position.

10. The system of claim 7, wherein, in the pin actuation mode, the pin hydraulic cylinder receives a hydraulic pressure of at least 500 pounds per square inch (3.4 megapascals).

11. The system of claim 10, wherein, in the pin actuation mode, the pin hydraulic cylinder receives a hydraulic pressure of at least 1000 pounds per square inch (6.9 megapascals).

12. The system of claim 11, wherein, in the pin actuation mode, the pin hydraulic cylinder receives a hydraulic pressure of 2000 pounds per square inch (13.8 megapascals).

13. The system of claim 7, wherein the hydraulic control system further includes a pressure reduction valve disposed upstream of the pin hydraulic cylinder.

14. The system of claim 7, wherein the controller is further configured to cease the ride control operation upon receiving the user command to initiate the pin actuation.

15. The system of claim 7, further comprising an engine, and wherein, if the engine is off, the controller is further configured to ignore the user command to initiate the pin actuation.

16. The system of claim 7, wherein the controller is further configured to, after completing the pin actuation, close the charge valve.

17. The system of claim 7, further comprising a solenoid operatively coupled to the controller, the controller configured to open and close the charge valve via the solenoid.

18. The system of claim 7, wherein the hydraulic control assembly further includes an accumulator, and the charge valve selectively fluidly communicates the accumulator with the pump.

19. A method of operating a work vehicle, the method comprising:

receiving a user command to initiate a ride control operation;

supplying pressurized hydraulic fluid to a boom hydraulic cylinder through a ride control valve assembly;

receiving a user command to initiate a pin actuation;

operating a portion of the ride control valve assembly without supplying pressurized hydraulic fluid to the boom hydraulic cylinder through the ride control valve assembly; and supplying pressurized hydraulic fluid to a pin hydraulic cylinder.

20. The method of claim 19, further comprising performing only one of the ride control operation and the pin actuation at a time.

* * * * *